US012559937B2

(12) United States Patent
Benasciutti

(10) Patent No.: US 12,559,937 B2
(45) Date of Patent: Feb. 24, 2026

(54) SECTION BAR FOR FRAME OF WALLS

(71) Applicant: MANNI GREEN TECH S.R.L., Verona (IT)

(72) Inventor: Enrico Benasciutti, Verona (IT)

(73) Assignee: MANNI GREEN TECH S.R.L., Verona (IT)

( * ) Notice: Subject to any disclaimer, the term of this patent is extended or adjusted under 35 U.S.C. 154(b) by 213 days.

(21) Appl. No.: 18/037,237

(22) PCT Filed: Nov. 12, 2021

(86) PCT No.: PCT/IB2021/060485
§ 371 (c)(1),
(2) Date: May 16, 2023

(87) PCT Pub. No.: WO2022/101835
PCT Pub. Date: May 19, 2022

(65) Prior Publication Data

US 2023/0417050 A1 Dec. 28, 2023

(30) Foreign Application Priority Data

Nov. 16, 2020 (IT) ..... 102020000027453

(51) Int. Cl.

| | |
|---|---|
| ***E04B 9/00*** | (2006.01) |
| ***E04B 2/74*** | (2006.01) |
| ***E04B 2/76*** | (2006.01) |
| ***E04B 2/78*** | (2006.01) |

(52) U.S. Cl.
CPC ..... *E04B 2/766* (2013.01); *E04B 2/7457* (2013.01); *E04B 2/789* (2013.01)

(58) Field of Classification Search
CPC ..... E04B 2/766; E04B 2/7457; E04B 2/789
See application file for complete search history.

(56) References Cited

U.S. PATENT DOCUMENTS

| | | | | |
|---|---|---|---|---|
| 4,918,899 | A * | 4/1990 | Karytinos | E04B 1/5818 52/690 |
| 5,081,813 | A * | 1/1992 | White | E04B 2/7457 52/656.1 |
| 6,374,558 | B1 * | 4/2002 | Surowiecki | E04B 2/7457 52/690 |
| 6,568,138 | B1 * | 5/2003 | Frost | E04B 2/767 52/656.1 |
| 7,850,390 | B2 * | 12/2010 | Lisbona | B01D 46/0004 403/231 |
| 10,633,856 | B2 * | 4/2020 | Leye | E04B 9/245 |
| 2006/0185312 | A1 * | 8/2006 | Weeks | E04C 3/07 52/653.1 |
| 2009/0107078 | A1 * | 4/2009 | Berridge | E04B 1/24 52/745.19 |

(Continued)

FOREIGN PATENT DOCUMENTS

| | | | |
|---|---|---|---|
| GB | 2436747 | A | 10/2007 |
| WO | 2019123388 | A1 | 6/2019 |

OTHER PUBLICATIONS

International Search Report for PCT/IB2021/060485 dated Feb. 24, 2022 (2 pages).

*Primary Examiner* — Basil S Katcheves
(74) *Attorney, Agent, or Firm* — Tutunjian & Bitetto, P.C.

(57) ABSTRACT

The present invention relates to a section bar usable in making a frame for walls as well as a frame structure including this section bar.

12 Claims, 6 Drawing Sheets

(56) References Cited

U.S. PATENT DOCUMENTS

| | | | | |
|---|---|---|---|---|
| 2013/0315663 | A1* | 11/2013 | Tu | E04B 2/58 403/362 |
| 2014/0290176 | A1* | 10/2014 | Rice | E04B 2/7457 52/696 |
| 2015/0337538 | A1* | 11/2015 | Florenske | E04F 13/0812 52/481.1 |
| 2015/0361659 | A1* | 12/2015 | Sessler | E04B 2/7457 52/483.1 |
| 2017/0037619 | A1* | 2/2017 | Dietzen | E04C 3/11 |
| 2017/0254081 | A1* | 9/2017 | Castellucci | E04B 2/60 |
| 2017/0363134 | A1* | 12/2017 | Thomas | F16B 43/001 |
| 2018/0148925 | A1* | 5/2018 | Rice | E04B 2/7457 |
| 2018/0195282 | A1* | 7/2018 | Pilz | E04B 2/7411 |
| 2019/0093359 | A1* | 3/2019 | Nanayakkara | E04B 2/845 |
| 2019/0301158 | A1* | 10/2019 | LeBlang | E04C 3/11 |
| 2020/0040577 | A1* | 2/2020 | LeBlang | E04C 3/04 |
| 2020/0048901 | A1* | 2/2020 | Schurig | E04B 2/7457 |
| 2020/0270857 | A1* | 8/2020 | Herfurth | E04B 2/7457 |
| 2020/0386005 | A1* | 12/2020 | Bélanger | E04G 21/1858 |
| 2021/0207370 | A1* | 7/2021 | Tognon | E04B 2/7457 |
| 2022/0120078 | A1* | 4/2022 | Sobel | E04B 2/789 |
| 2022/0251838 | A1* | 8/2022 | Saminathan | E04B 2/789 |

* cited by examiner

SECTION BAR FOR FRAME OF WALLS

TECHNICAL FIELD OF THE INVENTION

The present invention relates to a section bar, which can be used for making a frame for walls as well as a frame structure comprising such a section bar.

STATE OF THE ART

In the prefabricated building market, it is known to obtain a modular structure on which infill panels can be applied to define vertical walls.

These structures imply using vertical elements, such as uprights, operatively associated with horizontal reinforcement elements, such as oblique or horizontal crosspieces in order to obtain a support frame.

In general, the individual elements that make up this support frame can be metal section bars with a cross section that can be of different configurations and whose concavity, once laid, is oriented inwards.

The transverse and oblique elements are fixed to the vertical uprights with their ends inserted into the recess of the profile of a corresponding upright or horizontal crosspiece. The ends of the oblique crosspieces are then fixed by riveting with one rivet only to the uprights or horizontal crosspieces, which they engage by overlapping.

In general, the ends of the oblique crosspieces are cut according to a plane orthogonal to the direction of extension of the crosspieces themselves.

This technical solution for fixing of an upright and an end of an oblique or horizontal crosspiece by means of a single fixing point on each side determines some drawbacks.

The international application published under number WO2019123388A1 describes a frame structure for walls comprising a first element and a second element operably associable with each other, with the first element and the second element comprising a respective central wall and two opposite side walls delimiting at least one longitudinal recess.

This structure is made up of metal section bars connected to each other, which, due to their design, have one possible constraint position only. This determines that the frame structure has little versatility.

Furthermore, if the frame itself is to be used for other purposes, the configuration of the section bars making up the frame limits its functionality.

There is a need in the field of a frame structure with a high versatility of construction and high functionality as well as able to overcome the aforementioned drawbacks as part of a solution that is easy to be used and practical to be implemented.

SUMMARY OF THE INVENTION

Therefore, the main object of the present invention is to improve the state of the art concerning the section bars that can be used in the production of a frame for walls.

Another purpose of the present invention is to provide a section bar that can be used in the construction of a frame for walls capable of ensuring high versatility in the obtainment step of the frame.

A further object of the present invention is to provide a section bar that can be used for obtaining a frame for walls capable of ensuring more functionality of employment when used for obtaining a frame for walls.

Yet another object of the present invention is to provide a section bar that can be used in the construction of a frame for walls capable of ensuring high resistance should the frame be used to support huge amount of weight or horizontal thrusts in its respective plane.

According to an aspect of the present invention, a section bar is provided which can be used for the construction of a frame according to the present application.

Another object of the present invention is to make it possible to fix section bars to each other with a connection providing suitable connection means according to the loads acting on the members.

The present application refers to preferred and advantageous embodiments of the invention.

BRIEF DESCRIPTION OF THE DRAWINGS

Further characteristics and advantages of the present invention will become more evident from the detailed description of preferred, non-exclusive embodiments of a section bar that can be used for the construction of a frame illustrated by way of a non-limiting example in the enclosed drawings in which.

In the accompanying drawings, identical parts or components are indicated by the same reference numbers.

Figure 1:
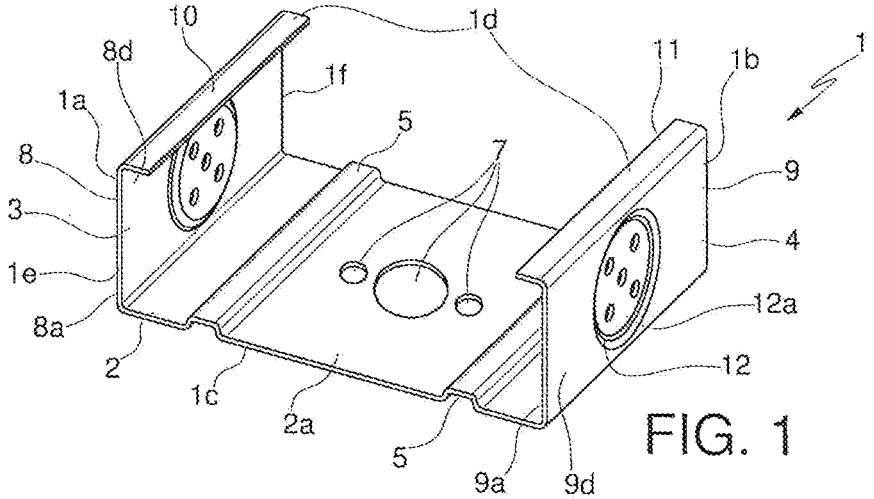
FIG. 1 is a perspective view of an embodiment of a section bar according to the present invention.
Figure 2:
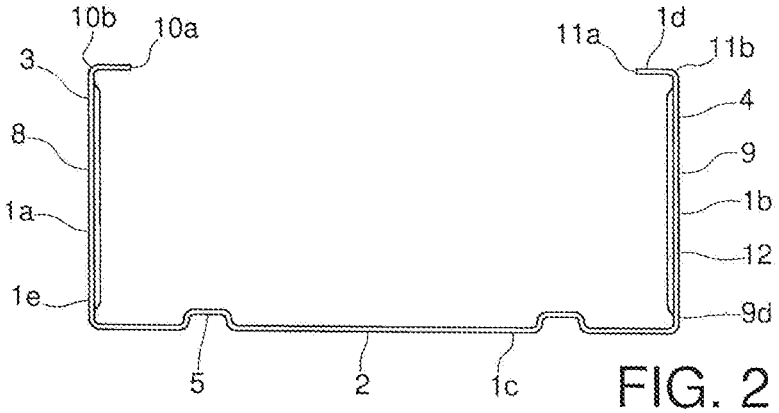
FIG. 2 is a front view of the section bar of FIG. 1.
Figure 3:
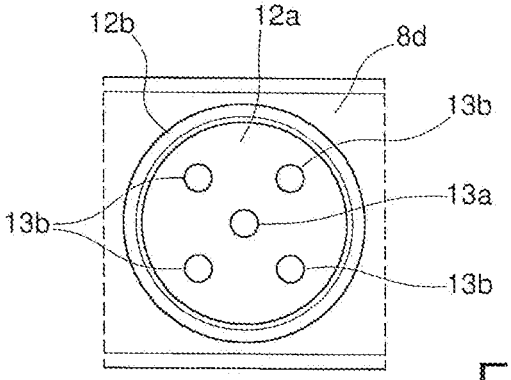
FIG. 3 shows a detail of the section bar of FIG. 1.

Moreover, with particular reference to FIGS. 1, 4, 6 and 8, the length of the section bar would clearly be much greater than that illustrated.

DETAILED DESCRIPTION OF THE INVENTION

With reference to the attached figures, a section bar according to the present invention which can be used for the construction of a frame is indicated as a whole with the reference number 1.

This section bar 1 comprises at least one main wall 2 and at least two side walls 3, 4.

As regards the at least one main wall 2, it can comprise one or more longitudinal reinforcement ribs 5 and/or delimit one or more first through openings or constraint through openings 7 useful for the possible engagement of one or more objects in the section bar 1 or for the possible constraint of the section bar 1 itself to a partition or wall.

By way of non-limiting example, the longitudinal reinforcement ribs 5 can have a trapezoidal or prismatic extension with a height between about 3 mm and about 5 mm, for example about 3.8 mm, and a width between about 8 mm and about 10 mm, for example 8.75 mm.

As regards the at least two side walls 3, 4, they each comprise at least a first segment 8, 9 which departs from a respective first end of the main wall 2 in a direction which can be transverse or substantially perpendicular to the plane of the main lying or extension of the main wall 2, so that the first segments 8, 9 of the at least two side walls 3, 4 define a substantially U-shaped configuration with the main wall 2.

Clearly, the two side walls 3, 4 could define a U-shaped configuration with the main wall 2 even if they do not extend in a direction orthogonal to the lying plane of the main wall 2, but inclined with respect to it, for example so as to define an angle between 60° and 120°.

In particular, each of the at least two side walls 3, 4 includes a second segment 10, 11 which extends from a respective first segment 8, 9, more particularly from one end of the latter distal from the main wall 2. The second segment 10, 11 is inclined relative to the first segment 8, 9 in such a way that the second segments 10, 11 have their respective free longitudinal or main or greatest ends 10*a*, 11*a* (i.e., extending along the longitudinal or main development axis of the section bar) at a first distance less than the second distance between the respective ends 10*b*, 11*b*, which are proximal or for constrain with or of continuation of the respective first segment 8, 9.

In practice, the free ends 10*a*, 11*a* of each second inclined segment 10, 11 face the longitudinal centerline of the section bar 1.

If desired, the second segments 10, 11 are orthogonal to the first segments 8, 9 and, if desired, substantially parallel to the main wall 2.

The section bar 1 comprises two flanks 1*a*, 1*b* consisting of the first segments 8, 9, two main sides 1*c*, 1*d*, one 1*c* consisting of the main wall 2 and the other 1*d* which is defined by the second segments 10, 11 spaced apart with each other, whereby the segment 1*d* is in fact interrupted between the free ends 10*a*, 11*a*.

The other two front and rear faces 1*e*, 1*f* of the section bar 1 are in fact open and substantially U-shaped, each being defined by the respective free edge of the main wall 2, by the first segments 8, 9 and by a respective minor free edge of the second segments 10, 11 which constitute the continuation of the free edge of the respective first segment 8, 9.

Thus, the section bar 1 has a height defined by the distance between the main wall 2 and the second segments 10, 11 or in any case by the extension of the first segments 8, 9 when passing from the main wall 2 to the second segments 10, 11, width defined by the distance between the two flanks 1*a*, 1*b* and a length which extends along a main longitudinal axis in the direction from the front face 1*e* to the rear face 1*f*.

Preferably, the flanks 1*a*, 1*b* of the section bar 1 are symmetrical to each other with respect to a median plane substantially parallel to the two first segments 8, 9 of the two side walls 3, 4 and equidistant from them or to a plane orthogonal to the main wall 2 and equidistant from the first two segments 8, 9.

A section bar is preferably made in one piece, in a suitable material, such as a metallic material, if desired aluminum.

Preferably, the main wall 2 is flat. If desired, the main wall 2 has an extension in the direction of the width of the section bar of about 130-150 mm, if desired, about 140 mm.

Advantageously, the first segments 8, 9 are flat. If desired, the first segments 8, 9 have an extension in the direction of the height of the section bar of about 40-60 mm, if desired, between 45 and 55 mm or equal to about 50 mm.

If desired, the side walls 3, 4 each define at least one raised portion 12.

The raised portions 12 preferably have an extension in a plan view, which is circular or substantially circular, but in other versions of the invention they could also present different extension in a plan view, for example polygonal.

By way of non-limiting example, the raised portions 12 can have a diameter ranging between about 35 mm and about 45 mm, for example about 40 or 41 mm.

Preferably, at least a raised portion 12 is formed recessed in the first segment 8, 9 of a respective side wall 3, 4 so as to protrude with respect to the latter within the section bar 1 or in any case in the direction of approaching the other side wall 4, 3.

Alternatively, at least one raised portion 12 could protrude outwards from the respective first segment 8, 9 of a respective side wall 3, 4, i.e. protruding in the direction of moving away from the other side wall 4, 3.

In this regard, at least a raised portion could be recessed or protruding outward by about 1-3 mm, if desired between 2 and 3 mm, for example about 2.75 mm with respect to the respective first segment 8, 9.

Clearly, all of the raised portions could be recessed or protruding or there could be a combination of these variants.

So far as the position of the raised portions 12 is concerned, they can for example be at a distance of between about 1 mm and about 30 mm, for example 10-20 mm, from a respective front face 1*e* or rear face if of the section bar 1.

Naturally, one or more raised portions 12 can be provided in a section bar 1, for example two, three, four or more.

Preferably, for each raised portion 12 in a side wall 3, a raised portion 12 is provided at the other side wall 4 at the same level or longitudinal extension of the section bar 1 and substantially symmetrical with respect to a median plane substantially parallel to the two first segments 8, 9 of the two side walls 3, 4 and equidistant from them or to a plane orthogonal to the main wall 2 and equidistant from the two first segments 8, 9.

Basically, for each first raised portion 12 in a side wall 3, a second raised portion 12 is preferably provided in the other side wall 4 substantially aligned to the first 12 in the direction from one flank 1*a* to the other 1*b* orthogonally to the direction of main extension of the section bar 1.

If desired, two raised portions 12 are provided, one for each side wall 3, 4, at or a distance ranging between about 1 mm and about 30 mm, for example 10-20 mm of both the front face and the rear face 1*e*, if of profile 1.

Naturally, raised portions 12 can be provided, also or alternatively to what has been indicated, at intermediate portions of the section bar 1.

More specifically, at least one or each raised portion 12, regardless of whether it protrudes towards the inside or the outside of the section bar 1, is constituted by a section of a lowered wall 12*a* or wall offset with respect to a section of the main wall 8*d*, 9*d* of the respective first segment with a connecting section 12*b* between this section of lowered wall 12*a* and the section of main wall 8*d*, 9*d*.

According to the non-limiting embodiment illustrated in the figures, the section of the lowered wall 12*a* has a circular or polygonal base, while the connecting section 12*b* is tubular with a circular or polygonal section, if desired decreasing towards the respective section of the lowered wall 12*a*.

In these raised portions 12 one or more second through openings 13*a*, 13*b* are delimited for the connection, by means of connective means 14, if desired screws or bolts, of the section bar 1 with other components of a frame or frame structure 15, such as for example other types of section bars or other shaped elements.

Advantageously, the one or more second through openings 13*a*, 13*b* are arranged in a symmetrically radial manner or distributed in a uniform way in the raised portions 12 or better in the respective section of the lowered wall 12*a*.

With the expression "distributed in a uniform way" it is meant that the openings 13*a*, 13*b* are not concentrated in a position of the raised portion 12, but they are distributed therein so as to have the greatest number of openings, with the distance between themselves not less than about 0.8 mm and about 1.2 mm, for example not less than about 1 mm.

In detail, it is possible to attribute radial symmetry to a plane figure when, for example, by defining the center of the polygonal or circular shape of the plan extension of the raised portions 12 as the center of radial symmetry of the starting flat figure, there is a clockwise rotation and/or counterclockwise different from 360° of the same around the center of radial symmetry, which allows to obtain another flat figure that perfectly overlaps the starting flat figure.

According to the variant of the invention shown in FIG. 1, in each raised portion 12 and more particularly in the respective section of the lowered or staggered wall 12*a*, five through openings for the connection 13*a*, 13*b* are delimited.

More specifically, in one or more raised portions 12, an opening 13*a* is formed substantially centrally in the respective raised portion 12, while the other, if desired four, through openings 13*b* for the connection are aligned along a circumference enclosing the second opening 13*a* central and substantially with a center in the latter.

More particularly, according to the embodiment illustrated in the figures, the external through openings 13*b* are arranged equally spaced apart from each other by a distance comprised between about 5 mm and about 6 mm, for example about 5.5 mm, and are then spaced with respect to the central through opening 13*a* by a distance comprised between about 0.8 mm and about 1.2 mm, for example about 1 mm.

It will be understood how, in this particular arrangement, a clockwise and/or counterclockwise rotation, for example of 90°, with respect to the center of radial symmetry ensures obtaining a figure equal to the starting figure.

This particular arrangement of the through openings 13*a*, 13*b* ensures to optimize the space inside the raised portions 12 and at the same time to obtain the best level of bearing capacity of the section bar 1 when connected with other components of the frame 15.

Clearly, the second openings 13*a*, 13*b* could also be in a different number to what is illustrated, although the number of the same would preferably increase or decrease as a function, respectively, of the increase or reduction of the width of the raised portion 12 and more in detail of the respective section of lowered or staggered wall 12*a*.

Thus, for example, with a raised portion 12 or better with a section of lowered or staggered wall 12*a* of larger dimensions, it would be possible to have six, seven or more second through openings, while still ensuring that the latter are distributed in a homogeneous manner and, for example, at a distance from each other of not less than about 0.8 mm and about 1.2 mm, for example about 1 mm.

If desired, there could be second through openings 13*a*, 13*b* distributed along concentric circumferences, if desired with the center in the center of the respective raised portion 12 or of the respective section of lowered or staggered wall 12*a*.

In fact, each through opening 13*a*, 13*b* inside the raised portions 12, when engaged by a respective connective means 14 increases the bearing capacity of the section bar 1, but if a correct balance between the forces involved should be maintained, a distributed and non-concentrated arrangement of the through openings for the connection 13*a*, 13*b* is required.

The particular arrangement described above is capable of optimizing both the number and the position of the through openings 13*a*, 13*b* for the connection with respect to the surface of the available raised portions 12.

Figure 4:
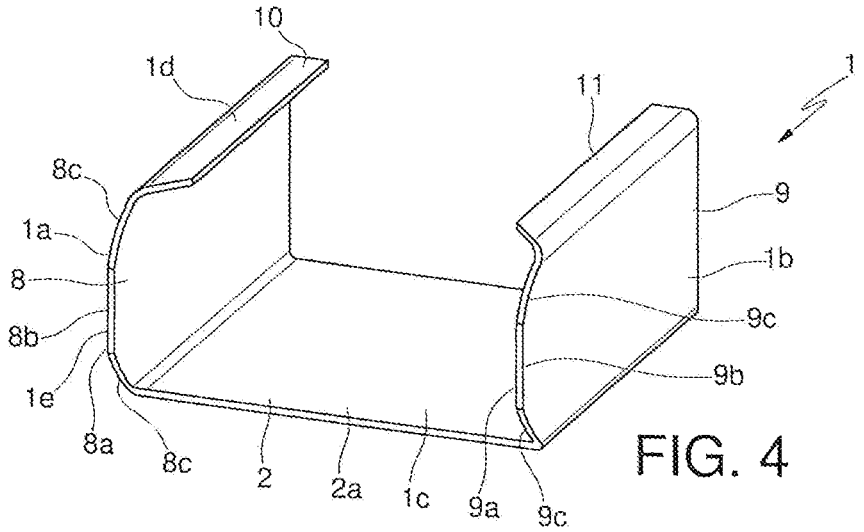
FIG. 4 is a slightly top perspective view of another embodiment of a section bar according to the present invention.
Figure 5:
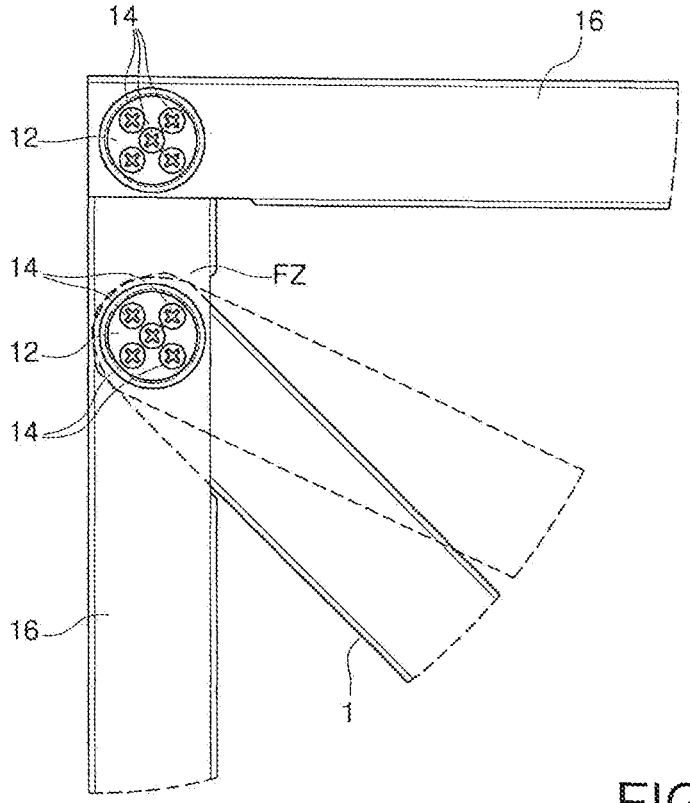
FIG. 5 shows a detail of the operation when connecting the section bar of FIG. 4.

Advantageously, the two segments 8, 9 are each provided with two free ends or edges 8*a*, 9*a* at least one of which is fully or partially curved (see FIGS. 4 and 5). Even more advantageously, at least one free end 8*a*, 9*a* comprises a main section having a substantially semicircular or curvilinear development so as to define a concavity facing inwards or towards the transverse centerline of the section bar 1 and/or in which at least one of the free ends 8*a*, 9*a* comprises a main middle section 8*b*, 9*b* and two inclined or curved lateral sections 8*c*, 9*c* with respect to the main middle section 8*b*, 9*b* so that these sections 8*b*, 9*b*, 8*c*, 9*c* form a concavity facing towards the inside or towards the transversal centerline of the section bar 1 or a convexity facing the outside of the section bar 1.

In particular, each side wall 3, 4 or better the first segment 8, 9 of each side wall 3, 4 is substantially polygonal, for example substantially square or rectangular with four ends, one of which is connected or rather extending from the main wall 2, one opposite to the latter and from which the second inclined segment 10, 11 and the other two forming the free ends or edges 8*a*, 9*a*, which are opposite to each other, depart.

In this case, one and preferably both free ends or edges 8*a*, 9*a* are as described above, and thus curved or with at least one curved section and therefore they are not straight and perpendicular to the other two ends. Alternatively, one free end or edge 8*a*, 9*a* could be straight and the other as indicated above.

Preferably, the length of the first segment 8, 9 is greater than the length of the main wall 2 and of the second segment 10, 11 at the respective free edge 8*a*, 9*a*, so that the latter actually protrudes with respect to the main wall 2 and the respective second segment 10, 11.

Advantageously, the two free edges 8*a*, 9*a* of the two first segment 8, 9 at the same face 1*e*, if of the section bar 1 are symmetrical to each other with respect to a middle plane substantially parallel to the two first segments 8, 9 of the two side walls 3, 4 and equidistant from them or to a plane orthogonal to the main wall 2 and equidistant from the first two segments 8, 9.

Basically, the two free edges 8*a*, 9*a* curved in whole or in part form a fork-like part with two prongs of a respective face 1*e*, 1*f* of the section bar 1.

As regards the position of the raised portions 12 relative to the free curved ends 8*a*, 9*a* or with at least one curved portion, they can for example be at a distance between about 1 mm and about 30 mm, for example 10-20 mm, from such free ends 8*a*, 9*a*.

This particular configuration of the free ends or edges 8*a*, 9*a* together with the position of the raised portions 12 with respect to them allows, during the connection step of the section bar 1 with other components of the frame 15, that it is possible to fix the section bar 1 in a series of operating positions (see FIG. 5) with respect to a shaped element 16 or to another section bar 1, which operating positions are angularly displaced with respect to each other.

Actually, the curvature of the at least one free end 8*a*, 9*a* or of the inclined or curved lateral sections 8*c*, 9*c* with respect to the main middle section 8*b*, 9*b* allows/permits the angular rotation of the section bar 1 with respect to an inclination zone, which it is clearly the connection point by means of the connective means 14 between the section bar 1 and another component or section bar of the frame 15.

In this regard, with specific reference to FIG. 5, a section bar 1 is shown in engagement with a shaped element 16, if desired an upright or crosspiece of a frame structure 15 or also another section bar 1, which shaped element 16 or section bar 1 defines a fitting zone FZ for a free end 8*a*, 9*a* of the section bar 1. The fitting zone FZ can for example be defined by a U-shaped section of the shaped element 16 or of the section bar 1.

In this case, the free end 8*a*, 9*a* is not brought into contact with the bottom of the fitting zone FZ defined by the shaped element 16 or better with the internal surface of the latter, but is at a distance from it, for example of about 0.5-2 mm and thanks to its configuration (of the free end 8*a*, 9*a*) it is possible to constrain the section bar 1 to the shaped element 16 in a plurality of angularly spaced operating positions.

For the connection of the section bar 1 to the shaped element 16, for example, the connective means 14 can be used, if desired, screws or bolts. Thus, for example, both in the section bar 1 and in the shaped element 16 openings are formed to be aligned during the assembly process for the insertion of screws or bolts 14 into the so aligned openings.

Clearly, in this case, these openings 13*a*, 13*b* could be obtained in a raised portion 12 of the section bar 1 and, if desired, of the shaped element 16.

As regards this variant, this raised portion 12 would be clearly formed in one end of the section bar 1 to be inserted in the fitting zone FZ of the shaped element 16.

If, on the other hand, the free edge 8*a*, 9*a* were straight and thus perpendicular to the longitudinal extension axis of the section bar 1, then the corners of this edge would prevent or otherwise hinder this angular displacement. The expedient of providing such a protruding or fork-like edge 8*a*, 9*a* naturally increases the possibility of varying the constraint or anchoring position of the section bar 1 to another element of a frame structure.

According to the embodiments shown in FIGS. 6 to 9, at least a second inclined segment 10, 11 of the section bar 1 has two side parts or portions 10*c*, 11*c* spaced apart from each other so as to define a window W between the side parts or portions 10*c*, 11*c* and the corner 8*e*, 9*e* defined by the first segment 8, 9 in the area between the two side sections or portions 10*c*, 11*c*.

Figure 6:
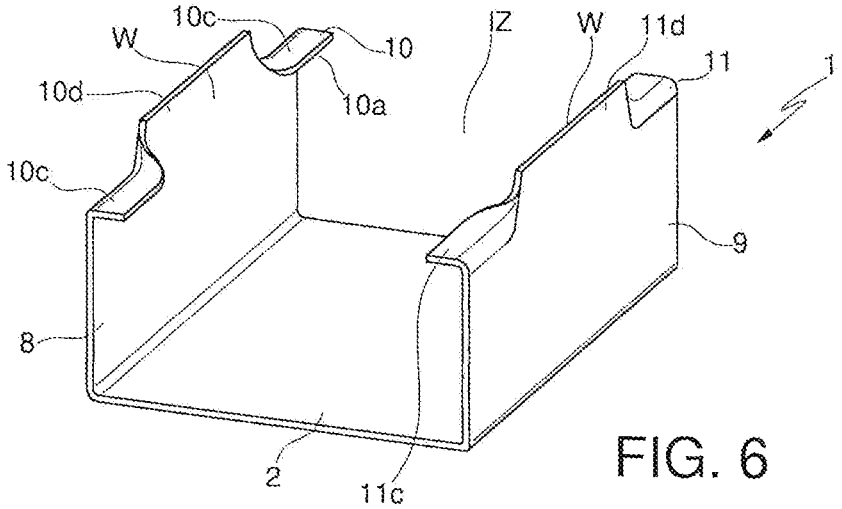
FIG. 6 is a slightly top perspective view of a respective embodiment of a section bar according to the present invention.

With reference to the example of FIG. 6, the second inclined segment 10, 11 also has a central portion 10*d*, 11*d*, which is bent towards the outside of the profile or away from the main wall 2, so as to be substantially aligned with the respective first segment 8, 9. Basically, according to this variant, each second inclined segment 10, 11 has a side section or portion 10*c*, 11*c* orthogonal or transversal to the respective first segment 8, 9 in the direction of the main extension axis of the section bar 1, the central portion 10*d*, 11*d* substantially aligned with the respective first segment 8, 9 or in any case with free ends at a distance from each other greater than the constraint or continuation end of the first segment 8, 9, and then another side section or portion 10*c*, 11*c*, which is orthogonal or transverse to the respective first segment 8, 9 and preferably aligned/or to the first side section or portion 10*c*, 11*c*.

Each central portion 10*d*, 11*d* can be obtained by cutting (at two suitably spaced cutting lines) and folding part of a second segment 10, 11 or by directly folding part of the latter without a previous cutting step.

The folding of the central portion 10*d*, 11*d* makes it possible not to remove or cut any amount of material from the section bar 1 and thus to keep the conditions of bearing capacity and stability of the same unchanged, making in any case the window W accessible for all its width.

Preferably, for a window W in a second segment 10, a window W is provided which extends along the same longitudinal segment also in the other second segment 11, that is to say that for a window W at a flank 1*a*, in the other flank 1*b* a window W is provided at the same level or longitudinal extension of the section bar 1 and substantially symmetrical with respect to a middle plane as indicated above.

Thanks to this expedient, between the thus aligned two windows W formed on the two flanks 1*a*, 1*b* of the section bar 1 an insertion zone IZ is defined in the section bar 1 or better in the respective U-shaped area defined by the main wall 2 with the two first segments 8, 9 of the side walls 3, 4 which is free or without a portion of second interception sections, which insertion zone IZ has a width equal to the distance between the two first segments 8, 9 and therefore wider than the distance between the main free ends 10*a*, 11*a* of the side sections or portions 10*c*, 11*c* as well as length equal to the distance between the two side sections or portions 10*c*, 11*c* of a respective flank.

Moreover, owing to this precaution, it is possible to insert in a first section bar 1 or better in the U-shaped area between the main wall 2 and the first two segments 8, 9, a second section bar 1 or a shaped element 16 so as to carry a respective side or front or rear face abutting or in any case close to the internal face 2*a* (internal to the respective U-shaped area of the section bar) of the main wall 2 and flush with or at a distance between 0.5 and 2 mm with the internal faces (internal to the respective U-shaped area of section bar) of the first segments 8, 9 of the side walls 3, 4 of the first section bar 1.

This clearly ensures that it is possible to easily constrain profiles or shaped elements of a frame structure, since it is possible to bring respective connective means or raised portions in a proximal or close position.

In this regard, in fact, the openings for connection by means of the connecting means 14 of a first section bar are preferably on the respective first segments 8, 9, so that the presence of the windows W ensures to bring walls of another section bar or of a shaped element to be constrained to the first profile flush with or close to the first segments 8, 9 bearing the openings for the connective means 14.

Of course, even if it is desired to weld or constrain two components of the frame structure 15 not with screws or bolts, the expedient concerning the presence of windows W would ensuring bringing close or side by side the respective sections of walls to be constrained.

Clearly, one, two or more W windows can be provided in each second segment.

Figure 8:
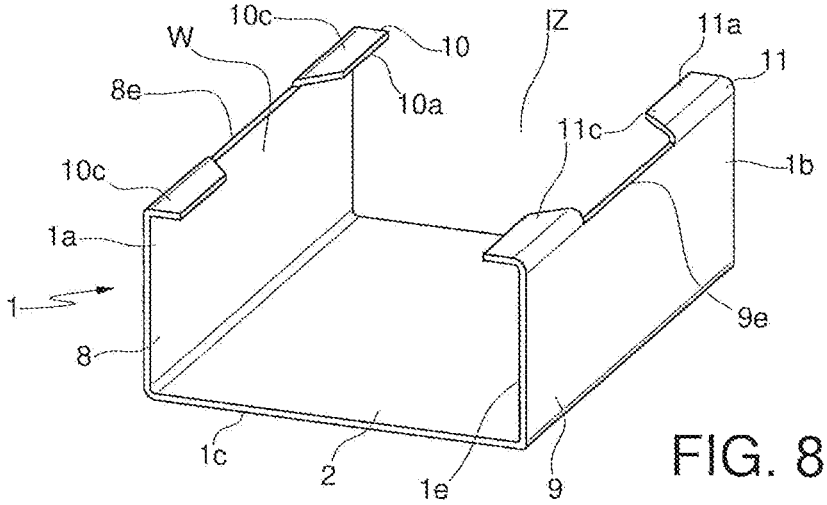
FIG. 8 is a slightly top perspective view of a respective embodiment of a section bar according to the present invention.

With reference instead to FIG. 8, it illustrates a section bar similar to that of FIG. 6, but in which no central portion 10*d*, 11*d* is provided, so that part of the second inclined segment 10, 11 is cut, if desired, after folding.

Both windows W present in the variants of the invention of FIGS. 6 and 8 can be advantageously used, as described above, for the passage or insertion of any components inside the section bar 1, for example electrical wiring or other electrical components of the frame 15 to which the section bar 1 can be connected or other section bars 1 or shaped elements.

Figure 7:
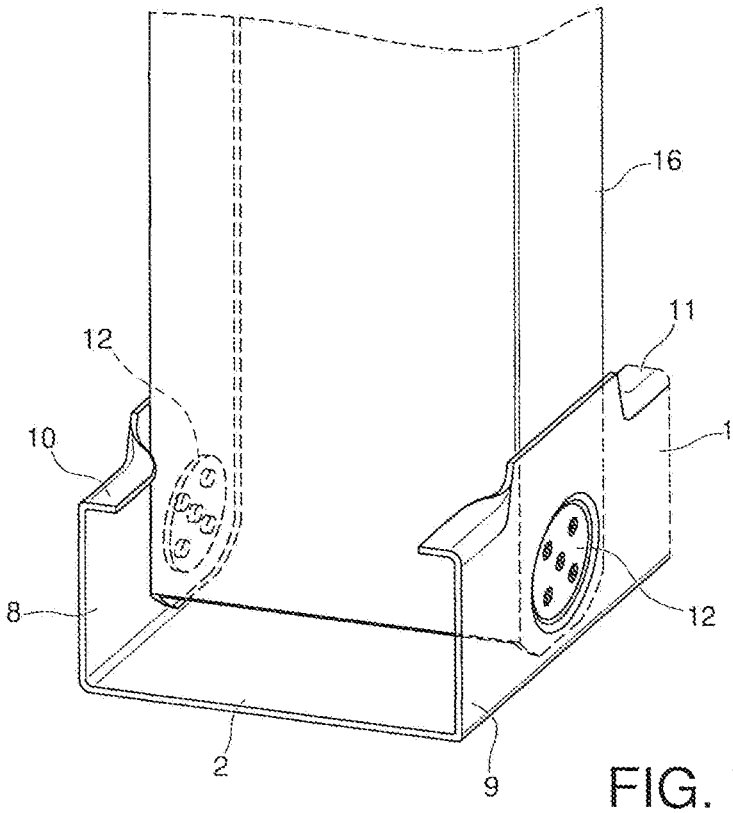
FIG. 7 is a slightly top perspective view of a detail of a frame structure according to the present invention with section bars according to FIG. 6.
Figure 9:
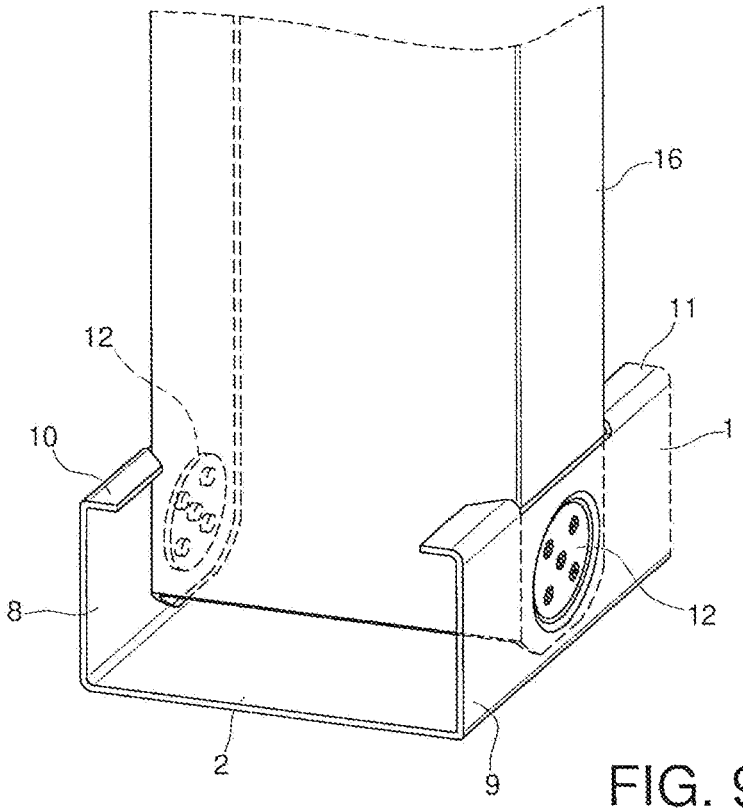
FIG. 9 is a slightly top perspective view of a detail of a frame structure according to the present invention with section bars according to FIG. 8.
Figure 10:
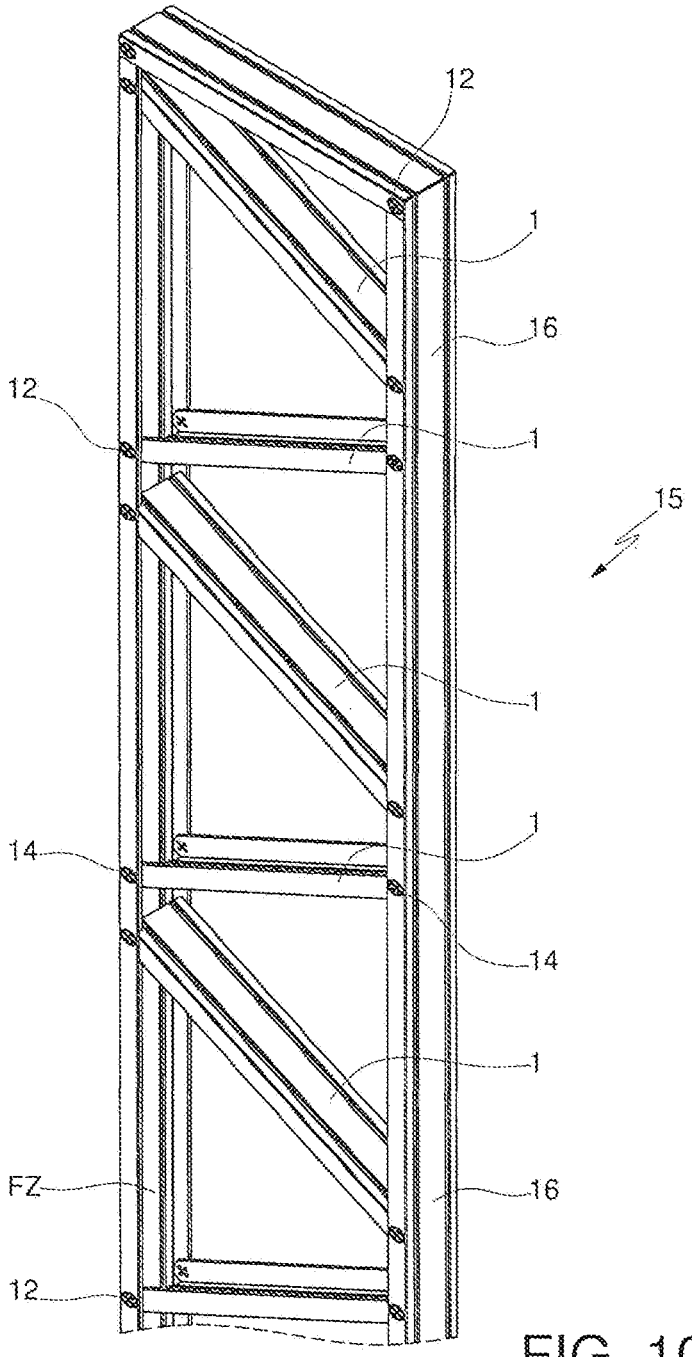
FIG. 10 is a slightly top perspective view of a frame structure according to the present invention.
Figure 11:
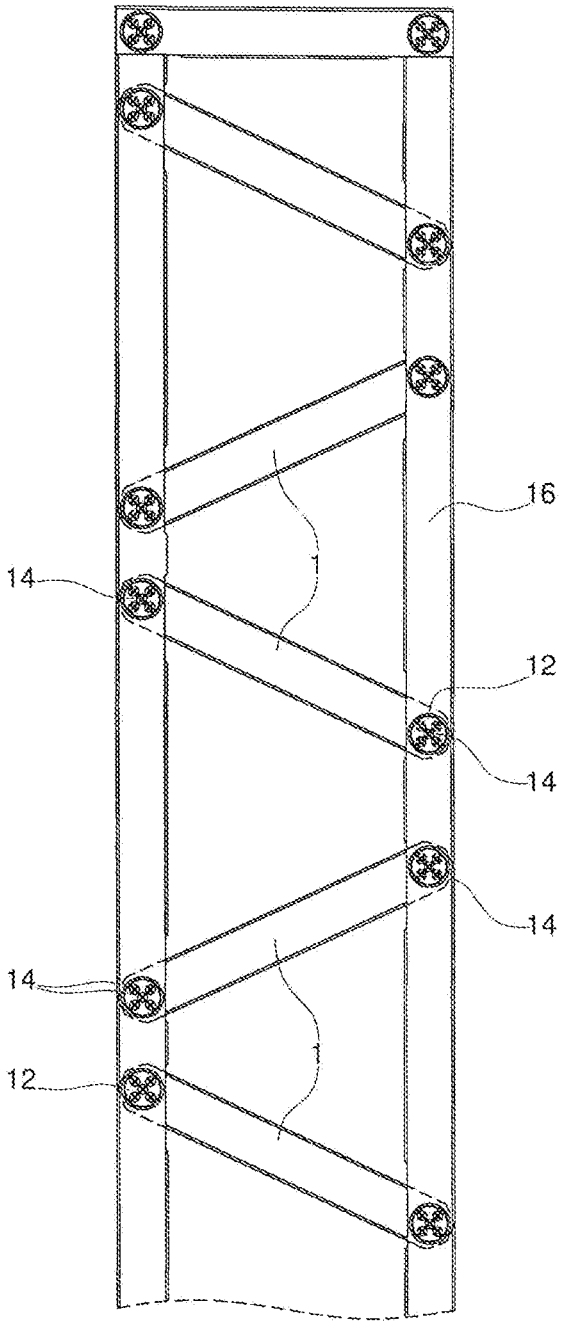
FIG. 11 is a front view of the frame structure of FIG. 10.

With reference in particular to FIGS. 7 and 9, in the section bar 1 and in particular in the area between two windows W aligned along a direction from one side 1*a* to the other 1*b*, another section bar 1 or a shaped element 16 is inserted, if desired with openings for connecting the latter facing or aligning with the through openings 13*a*, 13*b* for connecting the first section bar 1 or, as indicated above, without connection openings, in which case it would be necessary to apply glue or weld the walls of the two section bars or components of the frame structure, glue or welding thus constituting alternative connecting means to screws or bolts. Clearly, there could also be a variant in which the connection between components of the frame 15 is obtained either by means of screws or bolts, or by means of glue or welding.

In this regard, the insertion zone IZ defined between two windows W each aligned at a respective flank 1*a*, 1*b* could be used as a fitting zone FZ for use as described above for the insertion and fixing of a section bar with a free end 8*a*, 9*a* curved in whole or in part (see FIGS. 4 and 5).

A section bar according to the present invention can be obtained with any suitable method, for example by molding or by extrusion or even for combinations of these processes.

With particular reference to the method of obtaining a section bar 1 according to the example of embodiment of FIGS. 6 and 8, it comprises as an initial step of obtaining a shaped element such as that shown in the version of the invention in FIG. 1, providing or not the ribs 5, the openings 7 and/or the raised portions 12.

Subsequently, the step of folding a central section of at least a second segment 10, 11 inclined so as to define a window W between two side parts or portions 10*c*, 11*c* of the second segment 10, 11 and the corner 8*e*, 9*e* defined by the first segment 8, 9 in the area between the two side parts or portions 10*c*, 11*c*.

This central section can then be folded until it is substantially aligned with the respective first segment 8, 9 thus obtaining a section bar as illustrated in FIG. 6 or cut or removed so as to obtain the section of FIG. 8.

An object of the present invention is also a frame structure 15 comprising at least one section bar 1 constrained with another or other section bars 1 or with another or other shaped elements 16 by means of the connective means, such as for example screws or rivets 14 and/or with welding, gluing or other any suitable method.

In this case, if at least one free end 8*a*, 9*a* is provided in whole or in part curved, it is possible to constrain the section bar 1 to another section bar 1 or to a shaped element 16 in a plurality of operating positions, as shown in FIG. 5.

In practice, in the connection of the section bar 1 with the other at least one shaped element or other section bars of the frame structure 15, the free end 8*a*, 9*a* at least partially curved can be constrained in a plurality of angularly spaced operating positions, for example in an interval comprised between about 15° and about 120°, if desired between 450 and 90°. This makes the section bar 1 highly versatile, thus being able to be used in a variety of positions.

To this purpose, the section bar 1 with its free edge 8*a*, 9*a* is inserted into a fitting zone FZ of a shaped element 16 (if desired, of another section bar 1) and then the relative position of the section bar 1 relative to the shaped element 16 is established to then fix these components by means of screws, glue, welding or other.

To carry out this step, if screws or bolts are used, then a preliminary insertion or connection step could be carried out without tightening the screws or bolts 14, for example at openings 13*a*, 13*b* in the respective raised portions 12 after which, after having arranged the two components of the frame structure 15 in the desired reciprocal position, tighten the screws or bolts 14.

However, it is also possible to initially tighten the screws or bolts 14, and then, if necessary, unscrew them and, after suitable adaptations of the structure 15, tighten them again.

Consequently, it is also possible to create a highly customizable frame structure 15, since, thanks to the particular shaping of the free ends or edges 8*a*, 9*a*, it is possible to perform the angular displacements or inclinations described above, even after a first connection step.

Furthermore, the particular arrangement of the second through openings 3*a*, 3*b* in the respective raised portions 12 allows to optimize the bearing capacity and stability of the section bar 1 in the connection steps with the other or other shaped or sectioned elements of the frame structure 15.

If in particular section bars 1 are provided and, if it is desired shaped elements 16 with raised portions 12, then raised portions 12 of these components 1, 16 should be in engagement with each other, that is to say that a raised portion of a first section bar 1 should be housed or house a raised portion of a shaped element or other section bar to which the first section bar 1 must be constrained; in this case the through openings of the raised portion 12 of the first section bar 1 should be clearly aligned with the through openings of the raised portion of the shaped element or the other section bar to then insert connecting screws or bolts in the thus aligned openings. This is repeated preferably for all the raised portions of all the section bars.

Clearly, how to engage raised portions of components to be constrained depends on whether such portions are recessed or protruding.

If windows W are then provided, this arrangement clearly guarantees a simpler and more effective bond between components of the frame structure 15.

It has thus been seen that the present invention fully achieves the proposed objectives.

The section bar 1 thus conceived is susceptible of numerous modifications and variations, all falling within the scope of the inventive concept.

The invention claimed is:

1. A frame structure comprising at least a first section bar comprising at least one main wall and at least two side walls, each of said at least two side walls comprising at least a first segment departing from a respective first end of said at least one main wall in a transverse direction or substantially perpendicular to the plane of the main lying or extension of said at least one main wall, so that the first segments of said at least two side walls define with said at least one main wall a substantially U-shaped configuration, each of said at least two side walls including at least a second segment extending from the respective first segment and inclined relative to the latter in such a way that the second segments have their respective free longitudinal ends at a first distance less than the second distance between the respective proximal ends or the respective ends of connection with the or continuation of the respective first segment, wherein each of said at least two first segments of said side walls is provided with at least a free end or edge curved in whole or in part, wherein each of said at least two side walls of said first section bar defines at least one raised portion and wherein one or more through openings are delimited in said raised portions for the connection by way of connective means of said section bar with other components of said frame structure, and at least another section bar connected to said at least one first section bar by means of connective means, said another section bar comprising at least one main wall and at least two side walls, each of said at least two side walls comprising at least a first segment departing from a respective first end of said at least one main wall in a transverse direction or substantially perpendicular to the plane of the main lying or extension of said at least one main wall, so that the first segments of said at least two side walls define with said at least one main wall a substantially U-shaped configuration, each of said at least two side walls including at least a second segment extending from the respective first segment and inclined relative to the latter in such a way that the second segments have their respective free longitudinal ends at a first distance less than the second distance between the respective proximal ends or the respective ends of connection with the or continuation of the respective first segment, wherein each of said at least two side walls of said another section bar defines at least one raised portion and wherein one or more through openings are delimited in said raised portions for the connection by means of connective means with said first section bar, wherein said at least one second inclined segment has two side sections or portions spaced apart from each other so as to define a window (W) between said side sections or portions and the edge defined by said first segments in the area between the two side sections or portions, wherein said first section bar is engaged in the insertion zone (IZ) defined between two aligned windows (W) formed on two flanks of said another section bar.

2. The frame structure according to claim 1, wherein said at least one first section bar is inserted at a respective free end in a zone of fitting of said at least a shaped element or of said another section bar so that, as a function of the shape of said at least one free end, said section bar can be fixed in a series of operating positions with respect to said at least one shaped element or said another section bar.

3. The frame structure according to claim 1, wherein said second inclined segment of said another section bar has also a central portion, said central portion being bent towards the outside of the section bar or away from the main wall so as to be substantially aligned with the respective first segment, so that each second inclined segment has a side section or portion orthogonal or transversal to the respective first segment in the direction of the main extension axis of the another section bar, the central portion substantially aligned with the respective first segment or in any case with free ends at a distance from each other greater than the constraint or continuation end of the first segment, and then another side section or portion, which is orthogonal or transverse to the respective first segment.

4. The frame structure according to claim 3, wherein each central portion is obtained by cutting and folding part of a second segment or by directly folding part of the latter without a previous cutting step.

5. The frame structure according to claim 1, wherein said one or more through openings for the connection are arranged in a symmetrically radial manner or distributed in a uniform way in said raised portions.

6. The frame structure according to claim 1, wherein said raised portions have a circular or substantially circular extension in a plan view.

7. The frame structure according to claim 1, wherein one of said through openings for connection is centrally formed in said raised portion, while the other through openings for connection are aligned along a circumference enclosing the first opening.

8. The frame structure according to claim 7, wherein said other through openings are arranged equally spaced apart from each other by a distance comprised between about 5 mm and about 6 mm and are then spaced with respect to the central through opening by a distance comprised between about 0.8 mm and about 1.2 mm.

9. The frame structure according to claim 1, wherein the length of the first segments is greater than the length of the main wall and of the second segment at the respective free edge, so that the latter protrudes with respect to the main wall and to the respective second segment, in such a way that said free edges curved in whole or in part form a fork-like part with two prongs of a respective face of the section bar.

10. The frame structure according to claim 1, wherein said raised portions are located at a distance ranging between about 1 mm and about 30 mm from said free ends or edges of said first segments of said at least two side walls.

11. The frame structure according to claim 1, wherein at least one free end or edge of said at least two first segments comprises a main section having a substantially semicircular or curvilinear development so as to define a concavity facing inwards or towards the transverse centerline of the section bar.

12. The frame structure according to claim 1, wherein at least one free end or edge of said at least two first segments comprises a main middle section and two inclined or curved lateral sections with respect to said main middle section so that these sections form a concavity facing towards the inside or towards the transversal centerline of said section bar or a convexity facing the outside of said section bar.

* * * * *